United States Patent [19]

Kolt

[11] Patent Number: 4,596,181

[45] Date of Patent: Jun. 24, 1986

[54] PASSIVE BUILDING VENTS

[75] Inventor: Stanley Kolt, Mamaroneck, N.Y.

[73] Assignee: Leonard W. Suroff, Jericho, N.Y. ; a part interest

[21] Appl. No.: 771,641

[22] Filed: Sep. 3, 1985

[51] Int. Cl.[4] ..... F24F 7/00

[52] U.S. Cl. ..... 98/42.19; 98/119

[58] Field of Search ..... 98/42.16, 42.17, 42.19, 98/74, 78, 79, 119

[56] References Cited

FOREIGN PATENT DOCUMENTS 557545 5/1958 Canada ..... 98/119

20101 of 1892 United Kingdom ..... 98/42.19

*Primary Examiner*—Harold Joyce

*Attorney, Agent, or Firm*—Leonard W. Suroff

[57] ABSTRACT

A passive building vent is disposed in an opening provided in an outside vertical wall for communicating between the outside atmospheric air and the confined air space within the building and includes an inner vertical wall having a plurality of horizontally extending louvres with downwardly extending openings and a pair of side wall portions affixed to the inner vertical wall beyond the end of the louvres. A plurality of horizontally disposed vanes extend between the pair of side wall portions and are jounaled in apertures provided therein. The vanes extend downwardly in a vertical plane overlapping and are displaced inwardly providing a free air path therebetween. A coupling rod is provided to connect each of the vanes so that simultaneous movement thereof is obtained when atmospheric air flows in an upwardly direction between the side wall portions, a deflector vane, disposed proximate the lower edges of the side wall portions, closes the opening between the side wall portions and maintains the plurality of vanes in a generally open position.

12 Claims, 7 Drawing Figures

PASSIVE BUILDING VENTS

BACKGROUND OF THE INVENTION

1. Field of the Invention

The present invention relates to vents, and more particularly to a passive building vent which is suitable for installation in the outside wall of a multi-story building thereby equalizing the air pressure within the building to the outside atmospheric pressure.

2. Discussion of the Relevant Art

Numerous types of building vents are in use today. Their specific purpose is to provide a device for exhausting air from a confined space to the outside when the confined air either reaches a prescribed temperature or odoriferous particles have been trapped within the confined space and it is desirable to release the confined air to the outside atmosphere. In some instances these vents are utilized in conjunction with attic vents, which may be passive or powered, and they assist in the discharge of the confined air to the outside atmosphere.

Typical of these vents is an energy saver damper assembly disclosed in U.S. patent application Ser. No. 710,965, filed Mar. 12, 1985 by Stanley Kolt and a unidirectional vent, Ser. No. 673,586 filed Nov. 21, 1984 by the same inventor. In addition to providing the normal venting function the unidirectional vent provides for the equalizing of air pressures should a sudden drop in the outside or atmospheric air occur, such as experienced during tornados or other violent air disturbances. The unique property of the unidirectional vent is that it permits a prescribed amount of air to escape from a confined air space yet it provides for an instantaneous increase in the amount of air permitted to escape with sudden drops in outside or atmospheric air pressure. This feature prevents the confined air from causing damage to windows, and the like, with sudden drops of atmospheric air pressure.

The instant invention is ideally suited for use in multi-story buildings wherein the confined inner space may be continuously equalized with the outside atmospheric air and when combined with the unidirectional air vent can compensate for sudden drops in the outside atmospheric pressure. Thus the normal "chimney-like" effect which is caused in multi-story or high rise buildings when they are provided with a central heating or air conditioning system may now be eliminated, since the air pressure at each story is equalized to the outside air pressure. This decreases if not eliminates the drawing in of additional outside air into the system which would require additional capacity for the heating and air conditioning systems utilized therein.

Therefore, it is an object of the present invention to provide a passive building vent which is reliable and easily installable in multi-story buildings.

It is another object of the present invention to provide a reliable building vent capable of equalizing the air pressures between the confined air space and the atmospheric air with sudden drops in atmospheric air pressure.

It is another object of the present invention to provide a passive building vent suitable for use in high rise buildings which insures that the confined building air may be vented to the outside even when circulating atmospheric air currents flow in an upwardly direction.

It is yet another object of the present invention to provide a means for venting a multi-story building when low velocity outside atmospheric winds impinge directly upon the exhaust vanes of the vent.

It is still another object of the present invention to provide a passive building vent that provides for venting the confined air into the outside atmospheric air with high velocity winds impinging directly upon the exhaust vanes.

The present apparatus overcomes the shortcomings of the known art by providing a reliable, relatively inexpensive, venting apparatus which is passive and contains a minimum number of moving parts.

A passive building vent disposed in an opening provided in an outside vertical wall communicating between the outside atmospheric air and the confined air space within the building, according to the principles of the present invention, comprises an inner vertical wall having a plurality of horizontally extending louvres with downwardly extending openings and a pair of side wall portions affixed to the inner vertical wall beyond the end of the louvres. A plurality of horizontally disposed vanes extend between the pair of side wall portions and are journaled in apertures provided therein. The vanes extend downwardly in a vertical plane, overlapping, and are displaced inwardly providing free air passage therebetween. A coupling rod is coupled to each of the vanes and provides simultaneously movement thereof. An additional deflector vane is disposed proximate the lower edges of the side wall portion. The deflector vane closes the opening between the side wall portions and maintains the vanes in a generally open position when the atmospheric air flows in an upwardly direction between the side wall portions.

The foregoing and other objects and advantages will appear in the description to follow. In the description reference is made to the accompanying drawing which forms a part hereof, and which is shown by way of illustration a specific embodiment in which the invention may be practiced. This embodiment will be described in sufficient detail to enable the skilled and the art to practice the invention and it is to be understood that the other embodiments may be utilized and that structural changes may be made without departing from the scope of the invention. The following detailed description is, therefore, not to be taken in a limiting sense, and the scope of the present invention it is best to find by the appended claims.

BRIEF DESCRIPTION OF THE DRAWING

In order that the invention may be more fully understood, it will now be described, by way of example, with reference to the accompanying drawing in which.

DESCRIPTION OF THE PREFERRED EMBODIMENTS

Figure 4:
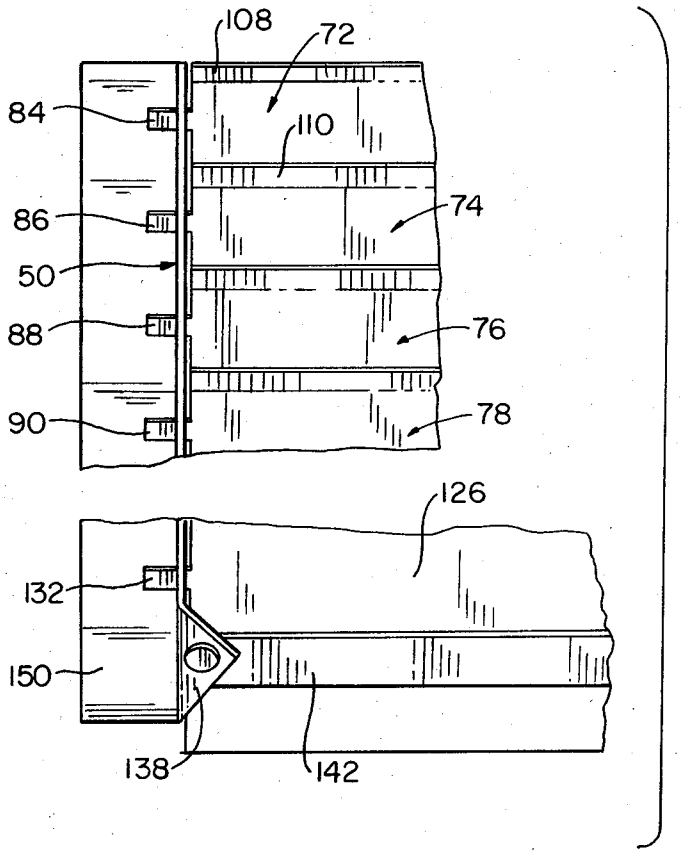
FIG. 4 is an enlarged partial rear view of the vent specifically showing the means of bracing the pair of side wall portions of the apparatus disclosed in FIG. 3.
Figure 1:
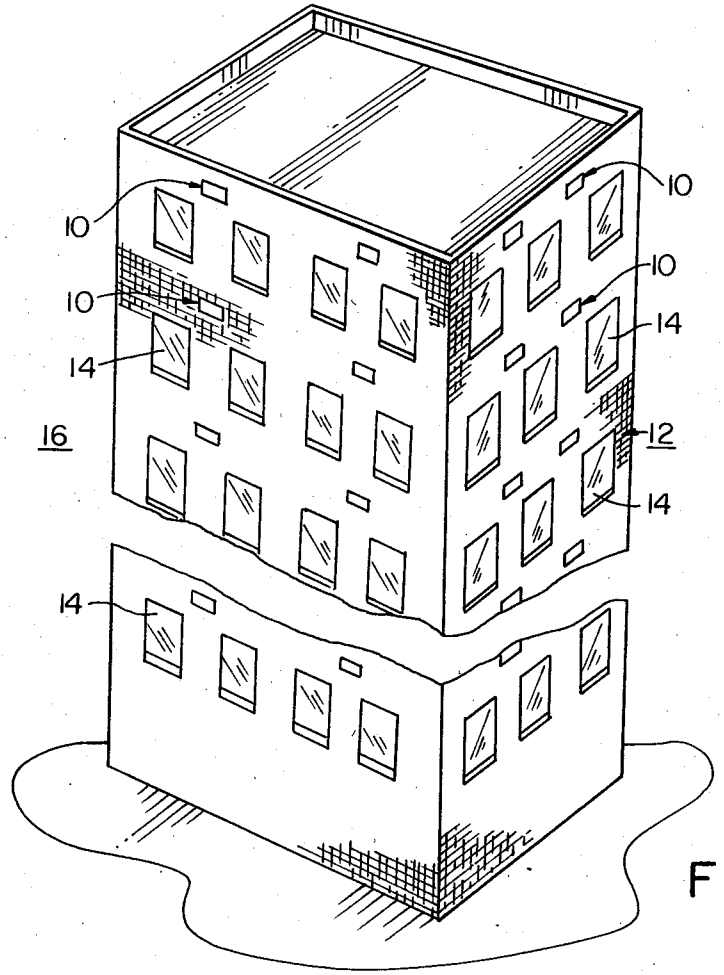
FIG. 1 is a perspective pictorial representation of a multi-story building in which the apparatus of the instant invention is installed.

Referring now to the figures, and in particular to FIG. 1, which shows the passive building vent 10 installed in a plurality of positions proximate the ceilings of each of a plurality of floors in a multi-story building 12. Typically these multi-story buildings are used for industrial or commercial use and the windows 14 provided therein generally are not made to open. Thus, each of the floors in a multi-story building is at a different atmospheric pressure, since there is no opening or venting to the outside atmosphere 16. As is well known, by those knowledgeable in the art, when providing heating and cooling, normally positioned in the basement of the building, to the various floors, a chimney effect occurs, thus causing additional atmospheric air to enter the building as the forced air is pushed to the upper stories during heating and air conditioning. The addition of outside or atmospheric air into the building increases the load on the heating and cooling systems. A plurality of the passive building vents 10 being installed in the outside vertical wall 18 which communicates between the confined air space in the building causes the equalization of the confined air 20 with the outside atmospheric air 16.

Figure 2:
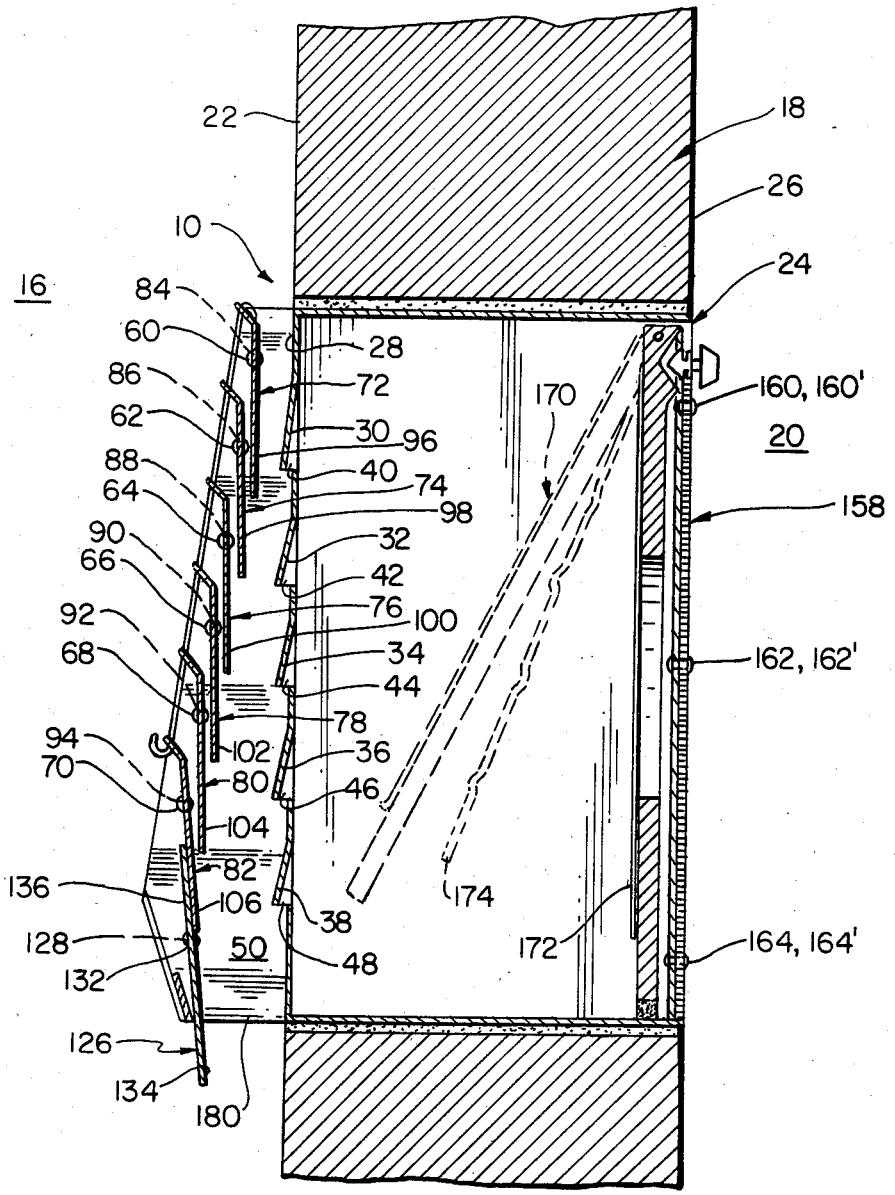
FIG. 2 is an enlarged cross-sectional view of the apparatus shown in FIG. 1 installed in an outside wall of the building.

Referring now to FIG. 2 which shows the passive building vent 10 installed in an outside building wall 18 which may be installed from the outside or exterior surface 22 of the wall 18 or alternatively, as will be explained hereinafter, may be installed together with a unidirectional vent 24 to provide a controlled exhaust vent, as well as, means for equalizing internal and external air pressures, should the outside atmospheric air pressure suddenly drop in pressure as a result of a tornado or other atmospheric disturbance. When the passive building vent 10 is combined with a unidirectional vent 24 installation thereof may be made from the inner wall surface 26, which will be explained in more detail hereinafter.

Figure 3:
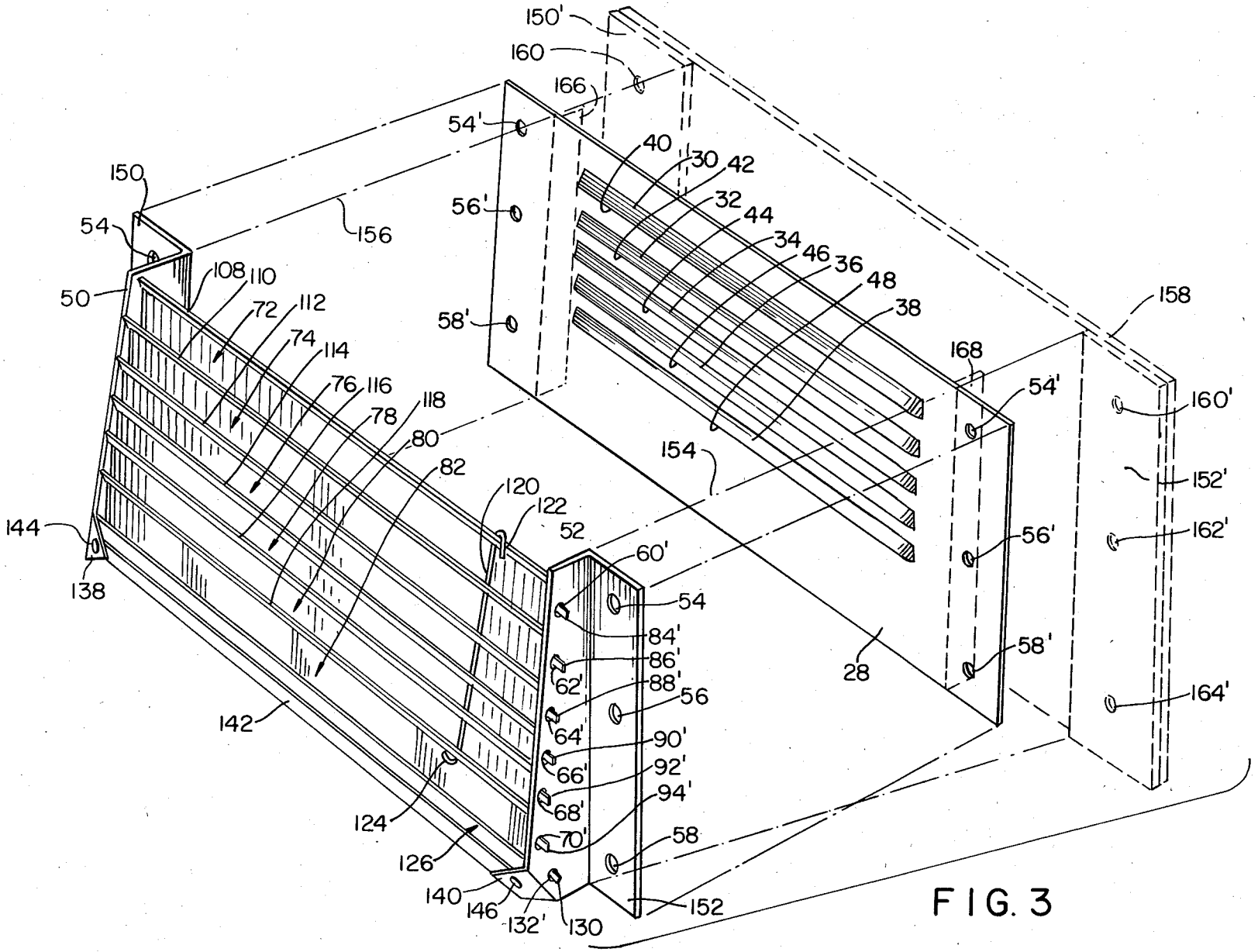
FIG. 3 is an enlarged exploded view of the passive air vent, according to the principles of the present invention, showing alternate embodiments thereof by broken lines.

Referring now specifically to FIG. 3, the passive building vent 10 includes an inner vertical wall 28 which provided with a plurality of horizontally extending louvres 30, 32, 34, 36 and 38, that are provided with downwardly facing or extending openings 40, 42, 44, 46 and 48, respectively. A pair of side wall portions 50 and 52 are affixed, in a conventional manner, by means of rivets not shown, to the inner wall beyond the end of the louvres 33, 34, 36 and 38 by means of a plurality of apertures 54, 56 and 58 which are positioned to cooperate with apertures 54', 56' and 58' provided on the inner wall 28 in one embodiment which utilizes a plurality of rivets therein, not shown. The side walls 50 and 52 are provided with a plurality of apertures 62, 64, 66, 68 and 70 being positioned so the uppermost aperture 60 is closest to the inner wall 28; each of the other apertures being further displaced therefrom. The apertures 60' 62', 64', 66', 68' and 70' being disposed in a like manner in side wall 52.

A plurality of vane members 72, 74, 76 78, 80 and 82 are provided with protruding end tabs 84 and 84'; 86 and 86'; 88 and 88'; 90 and 90'; 92 and 92'; and 94 and 94' of a size to permit ready journaling within the apertures 60 and 60'; 62 and 62'; 64 and 64'; 66 and 66'; 68 and 68'; and 70 and 70', respectively. Thus, vanes 72, 74, 76, 78, 80 and 82 are permitted to rotate freely and the gravitational forces will cause each of the vanes, with no air impinging thereon, to assume a vertical position providing unobstructed air spaces therebetween.

The end tabs 84, 86, 88, 90 and 92 (which also include their respective primes) are positioned so that the lower portions of vanes 72, 74, 76, 78, 80 and 82 are longer than the upper portions thereof insuring that with the increased length (and weight) the vanes will normally assume the vertical position. This occurs because the axis of rotation (tabs) positions are purposefully not placed in the exact center of a vertical elevation, thus insuring proper alignment during steady state conditions. The upper portion of vanes 72, 74, 76, 78, 80 and 82 are provided with an outwardly extending lip portion 108, 110, 112, 114, 116 and 118. The function thereof, when atmospheric air currents impinge thereon, will be explained hereinafter in conjunction with FIGS. 5 and 6.

A coupling rod 120 is thread through apertures, not shown in the lip portions 108, 110, 112, 114, 116, and 118 of each of the vanes with its distal ends 122 and 124 bent over on the first lip portion 108 and last lip portion 118 of vanes 72 and 82, respectively, thereby insuring that all the vanes will move in unison when acted upon by air currents.

An additional vane commonly referred to as a deflector vane 126 is provided with end tabs 128 and 130 which are journaled in apertures 132 and 132' provided in the side walls 50 and 52, respectively. Deflector vane 126 also has its end tabs 128 and 130 positioned off center in the vertical plane so that the lower portion 134 is longer than the upper portion 136 insuring that the vane is positioned almost vertically. Vane 126 is prevented from assuming a horizontal position by tabs 138 and 140 provided at the distal ends of side walls 50 and 52. Tabs 138 and 140 bend inwardly and a bracket 142 which extends and is riveted at both ends extending tabs 138 and 140 reinforce the side walls 50 and 52 adding rigidity to the structure.

The passive building vent 10 is capable of performing and providing satisfactory operation with any type of passive vent placed on the inner wall opposite the passive building vent. However, vent 10 is more ideally suited and provides additional benefits when utilized together with the unidirectional vent disclosed in Ser. No. 673,586, filed Nov. 21, 1984 described hereinbefore. Thus, in an alternative embodiment and with minor modifications, the passive building vent 10 may be fabricated as a unitary structure with which permits assembly from the inside of a building wall. These details are shown specifically in FIG. 3 in broken lines.

The side walls 50 and 52, instead of being provided with an outwardly extending flange portion 150 and 152, the side wall portions may be permitted to extend the full thickness of the building wall as shown by the broken lines 154 and 156 and may be provided with an outwardly extending flange portion 150' and 152'. The unidirectional vent 158 may then be affixed to flange portion 150' and 152' by means of the apertures provided therein which are adapted to receive rivets 160, 160'; 162 and 162' and 164 and 164' as shown in FIGS. 2 and 3. The end portions 166 and 168 of the inner wall 28 may be bent inwardly and riveted or welded to the extending portion of side walls 50 and 52, as shown in FIG. 3. Alternatively the flange portion 150 and 152 of side wall 50 and 52 may be affixed to the inner wall 28, in a conventional manner, and inner wall 28 may be provided with an extending flange portion after being bent to extend through the building wall 18 to have similar flange portions for receiving the unidirectional vent 158.

The operation and construction of the unidirectional vent 158 is set forth and described in U.S. patent application Ser. No. 673,586, and is hereby incorporated herein as if set forth at length.

The operation of the passive building vent is best illustrated together with FIGS. 2, 5, 6 and 7. FIG. 2 discloses the position of the vent vanes under steady state conditions with the vent installed in the building and without atmospheric air flow impinging upon the vanes. The unidirectional vent 158 may be positioned closed, as shown, or may be moved to a particular partially or fully open condition, as shown in the broken lines 170. The mylar membrane member 172 is free to move with air currents as shown by the broken line 174. The position that unidirectional vent 158 is placed in has no bearing on the function of the passive building vent, as will be described herein.

Figure 6:
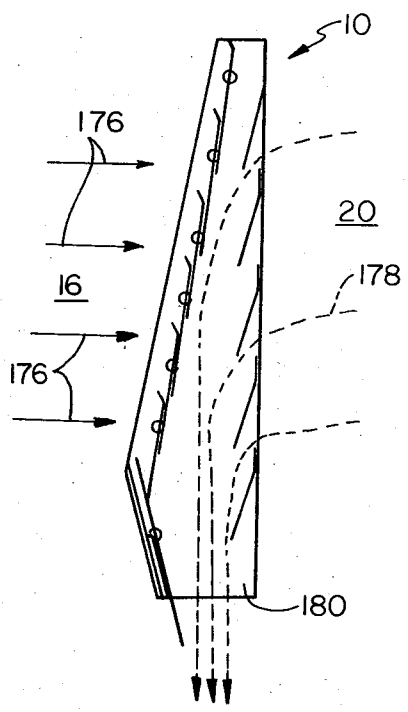
FIG. 6 is a pictorial representation of the vent in elevation with relatively high velocity air (over 9 mph) impinging therein; and, FIG. 7 is a pictorial representation of the vent in elevation with the air moving in an upwardly direction providing an alternative air exhaust path.

With atmospheric air impinging on the passive building vent 10 a velocity greater than 13 mph in the direction of arrows 176 (FIG. 5) the vanes 72, 74,76, 78, 80 and 82 will be deflected to essentially a closed position, as shown in FIG. 6. Air exiting from the confined air space 20 will take the path shown by the broken arrows 178 and will exit the building, via the opening 180 provided between the side walls 50 and 52.

Figure 5:
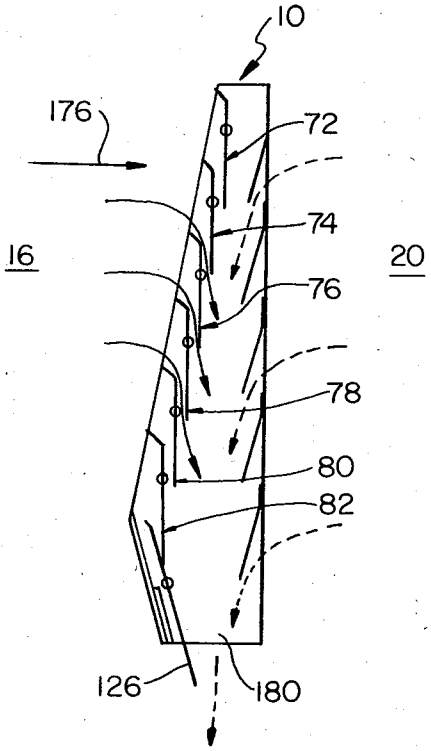
FIG. 5 is a pictorial representation of the vent in elevation, showing the position of the vanes with relatively low velocity (0–8 mph) air impinging thereon.

With air speeds (velocities) from 0 to 12 miles per hour the air paths will be as that shown in FIG. 5 and will flow in the direction of arrows 176 and the confined air 20 will take the path of broken arrows 178, as shown in FIG. 5. The exiting confined air 20 in the building 12 will combine with the atmospheric air 16 and exit near the opening 180 between the side walls 50 and 52.

Figure 7:
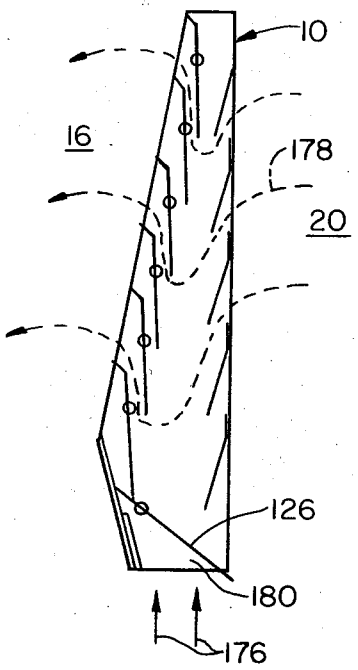

If the atmospheric air currents 16 are directed in upwardly direction, as indicated by arrows 176 in FIG. 7, attempt to enter near the opening 180 between side walls 50 and 52 the deflector vane 126 moves to a position which closes opening 180 and at the same time interferes with the closing of the vane 82 so that it remains in an essentially vertical position permitting the confined air 20 to follow the path as shown by the broken arrows 178 and exit, via the air space provided between the vanes. Thus, regardless of the velocity of the atmospheric air speed or its direction, venting can be accomplished from the confined air space 20 to the outside atmosphere 16. If a sudden drop of atmospheric pressure should occur, the membrane 172 moves toward the lower outside atmospheric pressure permitting the confined air to exit the building and thus, equalize the pressure instantaneously.

Hereinbefore has been disclosed a passive building vent which is inexpensive, reliable and capable of venting confined air within a building to the outside atmosphere under all conditions of and velocities of the atmospheric air impinging upon the passive building vent.

Having thus set forth the nature of the invention, what is claimed is:

1. A passive building vent disposed in an opening provided in an outside vertical wall communicating between the outside atmospheric air and the confined air space within said building comprising:

(a) an inner vertical wall having;
  (i) a plurality of horizontally extending louvres with downwardly extending openings, and
  (ii) a pair of side wall portions affixed to said inner vertical wall beyond the end of said louvres;
(b) a plurality of horizontally disposed vanes extending between said pair of side wall portions and journaled in apertures provided therein, said vanes extending downwardly in a vertical plane, overlapping and displaced inwardly providing a free air path therebetween;
(c) coupling rod means coupled to each of said vanes for providing simultaneous movement thereof; and
(d) deflector vane means disposed proximate the lower edges of said side wall portions, said deflector vane means closing the opening between said side wall portions and maintaining said plurality of vanes in a generally open position when said atmospheric air flows in an upwardly direction between said side wall portions.

2. A passive building vent according to claim 1 wherein said inner vertical wall is provided with an outwardly extending mounting flange means for affixing said inner vertical wall to the outer surface of said outside vertical wall.

3. A passive building vent according to claim 1 wherein said side wall portions are provided with horizontally extending mounting flange means for affixing said side portions to the outer surface of said outside vertical wall.

4. A passive building vent according to claim 1 further including a unidirectional vent means affixed to an inwardly extending bracket means provided on said passive building vent for providing a composite assembly suitable for installing from the confined air space side of said outside vertical wall.

5. A passive building vent according to claim 1 wherein said pair of side wall portions are reinforced by a bracket means extending between said side wall portions proximate the lowermost distal edges thereof.

6. A passive building vent according to claim 1 wherein said coupling rod means is affixed to the uppermost and lowermost horizontally disposed vanes and extends through apertures provided in the remainder of said horizontally disposed vanes.

7. A passive building vent according to claim 1 wherein said horizontally disposed vanes are each provided with an outwardly extending upper edge portion.

8. A passive building vent disposed in an opening provided in an outside vertical wall communicating between the outside atmospheric air and the confined air space within said building comprising:

(a) an inner vertical wall having;
  (i) a plurality of horizontally extending louvres with downwardly extending openings,
  (ii) a pair of side wall portions affixed to said inner vertical wall beyond the end of said louvres, and
  (iii) bracket means extending between said side wall portions proximate the lowermost distal edges thereof,
  (iiii) a horizontally extending mounting flange means for affixing said housing to the outer surface of said vertical wall; and
(b) a plurality of horizontally disposed vanes extending between said pair of side wall portions journaled in apertures provided therein, said vanes extending downwardly in a vertical plane, overlapping and displaced inwardly providing a free air path therebetween;

(c) coupling rod means coupled to each of said vanes providing simultaneous movement thereof, said coupling rod means being affixed to the uppermost and lowermost one of said vanes and extending through apertures provided in the remainder of said vanes; and (d) deflector vane means disposed proximate the lower edges of said side wall portions, said deflector vane means closing the opening between said side wall portions and being disposed to maintain said plurality of vanes in an open position when said atmospheric air flows in an upwardly direction through said opening.

9. A passive building vent according to claim 8, further including a unidirectional vent means affixed to said said mounting flange means for providing a composite assembly suitable for installing from the confined air space side of said outside vertical wall.

10. The method of providing a continuous air path in a building with a passive building vent comprising the steps of:

(a) providing an inner vertical wall having horizontally extending louvres with downwardly extending openings in the outside vertical wall of said building for communicating between the confined air space within said building and the outside atmospheric air;

(b) providing a plurality of horizontally disposed vanes extending between side wall portions provided on said inner vertical wall, said vanes being journaled in apertures provided therein and extending downwardly in a vertical plane displaced inwardly providing a free air path therebetween;

(c) providing means for insuring simultaneous movement in the same direction of all of said vanes, and (d) providing deflector vane means disposed proximate the lower edges of said side wall portions for closing the opening between said side wall portions and maintaining said plurality of vanes in a generally open position when said atmospheric air flows in an upwardly direction between said side walls.

11. A method according to claim 10 further including the step of (e) providing a unidirectional vent means juxtaposed said inner vertical wall and disposed upon said building inner wall surface for providing a continuous air path between said confined air and said atmospheric air.

12. A method according to claim 10 wherein said means for insuring simultaneous movement of said vanes comprises a rod disposed in an aperture disposed in said vanes and affixed to the uppermost and lowermost of said vanes.

* * * * *